US007484332B2

(12) United States Patent
Hörmann et al.

(10) Patent No.: US 7,484,332 B2
(45) Date of Patent: Feb. 3, 2009

(54) DOOR COMPRISING A LOCKING DEVICE

(75) Inventors: Thomas J. Hörmann, St. Wendel (DE); Herbert Brinkmann, Halle/Westfalen (DE); Franz Kraft, Arnsberg-Herbringen (DE); Michael Brinkmann, Halle/Westfalen (DE)

(73) Assignee: Hörmann KG Brockhagen, Steinhagen (DE)

( * ) Notice: Subject to any disclaimer, the term of this patent is extended or adjusted under 35 U.S.C. 154(b) by 522 days.

(21) Appl. No.: 10/511,521

(22) PCT Filed: Apr. 15, 2002

(86) PCT No.: PCT/EP02/04160

§ 371 (c)(1),
(2), (4) Date: Aug. 1, 2005

(87) PCT Pub. No.: WO03/087506

PCT Pub. Date: Oct. 23, 2003

(65) Prior Publication Data

US 2006/0053694 A1 Mar. 16, 2006

(51) Int. Cl.
*E05D 13/00* (2006.01)

(52) U.S. Cl. ..... 49/322; 49/200; 160/201

(58) Field of Classification Search ..... 49/322, 49/197, 199, 200; 16/201, 207, 84.06; 160/201, 160/207, 84.06
See application file for complete search history.

(56) References Cited

U.S. PATENT DOCUMENTS 2,274,552 A * 2/1942 Kingsland ..... 49/322
3,188,698 A * 6/1965 Zoll et al. ..... 49/322
3,579,910 A * 5/1971 Wetter ..... 49/322
4,385,471 A * 5/1983 Gabry et al. ..... 49/322
4,520,591 A * 6/1985 Calvagno ..... 49/322
4,604,828 A * 8/1986 Baarse ..... 49/322
5,291,686 A * 3/1994 Sears et al. ..... 49/322
5,337,520 A * 8/1994 Uribe ..... 49/197
6,189,266 B1 * 2/2001 Mihalcheon ..... 49/322
6,279,268 B1 * 8/2001 Beaudoin et al. ..... 49/322
6,401,793 B1 * 6/2002 Martin ..... 160/191
6,553,716 B2 * 4/2003 Bruns ..... 49/322
6,640,496 B2 * 11/2003 Mullet ..... 49/199
6,715,236 B2 * 4/2004 Mullet ..... 49/322
6,834,464 B2 * 12/2004 Shoemaker ..... 49/449
7,000,354 B2 * 2/2006 Beaudoin et al. ..... 49/322
7,089,990 B2 * 8/2006 Hormann et al. ..... 160/201
7,097,003 B2 * 8/2006 Reynolds et al. ..... 187/351

(Continued)

FOREIGN PATENT DOCUMENTS

DE 3730363 12/1988

(Continued)

*Primary Examiner*—Katherine W Mitchell
*Assistant Examiner*—Catherine A Kelly
(74) *Attorney, Agent, or Firm*—Friedrich Kueffner

(57) ABSTRACT

The invention relates to a door comprising a leaf that is movable between an open position and a closed position, a guiding element which is fixed to the door leaf, interacts with a guide rail, and directs the movement of the door leaf, and a locking device that is movable between a released position in which said locking device releases movement of the door leaf and a locked position in which said locking device counteracts movement of the door leaf. The locking device is provided with a locking element which stops at a contact surface of the guide rail when said locking device is moved into the locked position.

16 Claims, 3 Drawing Sheets

U.S. PATENT DOCUMENTS

| | | | | |
|---|---|---|---|---|
| 2002/0069585 | A1* | 6/2002 | Schiks | 49/200 |
| 2003/0041520 | A1* | 3/2003 | Mullet | 49/322 |
| 2003/0051408 | A1* | 3/2003 | Mullet | 49/200 |
| 2003/0051409 | A1* | 3/2003 | Bruns | 49/322 |
| 2005/0098275 | A1* | 5/2005 | Hormann et al. | 160/201 |
| 2005/0133170 | A1* | 6/2005 | Hormann et al. | 160/201 |
| 2005/0224194 | A1* | 10/2005 | Hormann et al. | 160/201 |

FOREIGN PATENT DOCUMENTS

| | | |
|---|---|---|
| DE | 3800404 | 7/1989 |
| DE | 3814275 | 2/1993 |
| FR | 2394660 | 1/1979 |

* cited by examiner

DOOR COMPRISING A LOCKING DEVICE

The invention pertains to a door with a leaf, which can be moved between an open position and a closed position; with a guide element, which is fastened to the leaf and which cooperates with a guide rail to guide the movement of the leaf; and with a locking device, which can be shifted between a release position, in which it allows the movement of the leaf, and a blocking position, in which it opposes the movement of the leaf, the locking device being equipped with a locking element, which, when the device is moved into the locking position, comes to rest against a contact surface of the guide rail, and to a locking device for these types of doors.

Doors of the type just described are realized in the form of, for example, so-called sectional doors, in which the door leaf consists of a plurality of panels, which are arranged next to each other in the direction in which the leaf travels, and which are hinged to each other so that they can pivot around axes which are perpendicular to the direction in which the leaf travels. In these sectional doors, the leaf of the door is usually in a vertical plane when the door is closed and in an overhead horizontal plane when the door is open. Guide rails are usually provided at each edge of the leaf to guide the movement of the leaf; these rails have a first, more-or-less vertical section, which is parallel to the lateral edge of the leaf when the door is closed; a second section, which extends in the horizontal direction and which is more-or-less parallel to the lateral edge of the leaf when the door is open; and an arc-shaped connecting section. Guide elements, especially guide rollers, are mounted on the leaf to cooperate with these guide rails; the guide rollers engage in the guide rails to enable the leaf to move smoothly.

To make it easier to open the door, i.e., to move the leaf from the closed position to the open position, counterbalancing systems are usually provided, which can be realized in the form of sets of tension springs or torsion springs. These springs are connected at the other end to the leaf by way of tensioning means attached to the lower edge of the door leaf. The springs are tensioned when the door is closed, i.e., moved from the open position to the closed position, and the energy stored in the springs is thus available to support the next opening movement. At the same time, these counterbalancing devices also prevent the door leaf from dropping down abruptly during the course of the closing movement.

To prevent damage to the door leaf and especially to prevent injury to the person using the door, it is also necessary to prevent the door from dropping uncontrollably even after the tensioning means and/or the springs used as the counterbalancing device have broken. For this reason, conventional doors of the type described above are usually equipped with locking devices, which prevent the door leaf from moving after the tensioning means and/or the springs forming the counterbalancing device have broken.

A door with this type of locking device is described, for example, in U.S. Pat. No. 1,936,269. The door described in this document has a locking device with a locking element realized in the form of a catch, which, after the tensioning means have broken, engages in an opening provided in the guide rail and thus prevents the door leaf from dropping down in an uncontrolled manner. Nevertheless, the presence of openings in the guide rail has the effect of weakening the rail. For this reason, the guide rail of the door described in this document is provided with an especially sturdy design, which includes a support plate and a total of four angle sections welded to this support plate.

In a door described in DE 37 30 363 C1, the locking device has a catch slide attached to the door leaf. A clamping jaw which surrounds a rod separate from the guide rail is held movably in this slide. The design of this locking device is especially complicated, because it requires not only the catch slide and the clamping jaw held inside it but also a separate rod to serve as a guide for the catch slide. During the use of doors equipped with safety devices of this type, furthermore, it has been discovered that it cannot be ensured that the descent of the door leaf will be braked reliably after the tensioning means or the counterbalancing device has broken.

The same problems with respect to operating reliability also occur in the case of the door described in DE 38 14 275 C2, the locking device of which has a brake shoe 6, which can be pressed by a spring against the outside surface of the guide rail. A significant improvement in operating reliability is not achieved with the locking devices described in DE 38 00 404 A1 either, in which a locking element 7 is held in the guide rail. After the tensioning means have broken and/or the counterbalancing device has been damaged, this locking element is pushed by a tension spring against an internal boundary surface of the guide rail, so that the locking teeth 9 of the locking element 7 can come into contact with this boundary surface.

In view of the problems of the state of the art explained above, the invention is based on the task of providing a door of the type described above, the leaf of which is reliably prevented from dropping uncontrollably and which nevertheless has a simple mechanical design with only a few individual parts.

This task is accomplished by an elaboration of the known doors, which is characterized essentially in that, when the locking element is in the locking position, it is pushed toward the contact surface of the guide rail by a thrust element, especially by the guide element, which is attached to the leaf.

This solution is based on the realization that the force of the spring acting on the locking element of the . . . in DE 38 00 404 A1 in the direction toward the locking position is not enough to produce a sufficient braking action, and that the weight of the door leaf, which acts only indirectly on this locking element, is not sufficient either to ensure the desired braking action even when locking teeth are provided on the locking element. The reason for this is that, when the locking device is in the release position, the locking element, like the roller for ensuring the smooth movement of the door leaf, has a certain amount of play in the guide rail, which means that it can escape inside the guide rail in a direction perpendicular to the contact surface.

In the door according to the invention, this escape movement is prevented in that the thrust element, which can be, for example, the guide element, presses the locking element toward the contact surface, thus reliably allowing the locking element to exert the desired blocking effect. This high degree of operating reliability can be achieved without any additional components, because, in comparison to the known locking devices, the locking element must be shifted only to a point at which it can be pressed by the guide element against the contact surface. In addition, the inventive locking device can be used even when the guide rails are not extra sturdy, because the danger of damage to the rails is reduced simply by the fact that the guide element makes two-dimensional contact with the guide rail instead of the more concentrated contact by the outward-projecting locking teeth of DE 38 00 404 A1, for example. For this reason, there is hardly any danger that the locking element could damage the guide rail. Obtaining a reliable locking effect by means of two-dimensional contact is made possible, furthermore, by the inventive positioning of the locking element at a point at which it can be pressed by the guide element against the contact surface. The contact surface of the guide element coming to rest against the contact surface of the guide rail can be in the form of a hard, roughened wedge-shaped surface.

Within the scope of the invention, the intention is also to design a locking device in which the locking element is pressed only indirectly, i.e., by the intermediate action of one or more force-transmitting elements, against the contact surface. For the sake of an especially simple design, however, it has been found to be especially favorable for it to be possible for the locking element to make direct contact with the guide element when the locking device is shifted into the locking position. In this case, the desired blocking of the movement of the door leaf can be achieved in an especially reliable fashion by providing the locking element with a first, preferably essentially flat contact surface, which comes to rest, when the device is in the locking position, against the guide rail, and with a second contact surface, which, when the device is in the locking position, comes to rest against the guide element, where the first contact surface and the second contact surface are at an acute angle to each other of preferably less than 30°, especially of about 20°.

When the tensioning means breaks, the locking element can be shifted into the locking position in an especially reliable manner by a pretensioning device, which pushes the locking element into the locking position. In this case, the locking device can be connected to a drive device and/or to a counterbalancing device realized in the form of, for example, a tension or torsion spring arrangement via a tensioning means in such a way that the drive device and/or the counterbalancing device can exert a force on it which opposes the pretensioning force of the pretensioning device and thus acts to push the locking device into the release position. When the tensioning means and counterbalancing devices or drive devices are operating properly, therefore, it is possible to ensure the trouble-free operation of the door. The locking device can be connected to the tensioning means and/or to the counterbalancing device very easily by providing the locking device with a lever, which is mounted so that it can pivot around a pivot axis extending transversely, especially more-or-less perpendicularly, to the longitudinal direction of the guide rail. The lever itself can be connected on one side of the pivot axis to the tensioning means and on the other side of the pivot axis to the locking element. In this case, the pivoting of the lever has the effect of pushing the locking element against the contact surface of the guide rail. An especially reliable way of ensuring that, in the course of this movement, the first contact surface of the locking element will arrive in two-dimensional contact with the contact surface of the guide rail is to mount the locking element on the lever in such a way that it can tilt around a tilt axis which is more-or-less perpendicular to the pivot axis. In the design of the locking device just mentioned, the pretensioning device can be realized very easily in the form of a torsion spring, which acts at one end on the lever and is supported at the other end at least indirectly on the door leaf.

As explained above, the danger of damage to the guide rail by the action of the locking element is reduced simply by the fact that the locking element makes two-dimensional contact with the contact surface of the guide rail. A further reduction in the risk of damage can be achieved without any significant extra effort by providing the locking device with a support element, which is located on the side of the guide rail opposite the contact surface of the guide rail. A support element of this type prevents the guide rail from bulging outward under the force of the locking element acting on the contact surface, because the corresponding part of the guide rail will come to rest against the support element, which prevents the outward bulging.

The locking element, like the support element, is advisably attached to the door leaf, so that it will move together with the leaf along the guide rail. Because the guide rail usually also has a curved guide rail section, it is preferable, as a way of ensuring the trouble-free movement of the door leaf, for the support element to be supported so that it, too, can pivot around the pivot axis. As a result, the support element can change position to conform to the shape of the arc-shaped guide rail section.

The guide element attached to the door leaf of an inventive door advisably has a support shaft, which is more-or-less perpendicular to the longitudinal direction of the guide rail and parallel to the plane of the door leaf; this shaft holds the guide element on the door leaf. In this case, a very simple design for mounting the lever carrying the locking element and/or the support element so that they are free to pivot is to allow the support shaft to pass through the lever and/or the support element. In this design, an especially compact assembly can be realized by also allowing the guide rail to pass through the torsion spring which pushes the locking device toward the locking position. As already discussed above, the locking device of the inventive door is advisably fastened to the door leaf. A very simple but also very strong method of realizing this attachment is to use a bracket element with a U-shaped profile. The bracket element has a connecting sidepiece, which is attached to a boundary surface of the door leaf, and two outer sidepieces, which are preferably more-or-less parallel to each other and through which the support shaft passes.

So that the door leaf can move with very little friction, it has been found advisable for the guide element to have a guide roller, which is supported so that it can rotate around the longitudinal axis of the support shaft, even though, within the scope of the invention, it is also possible to use simple guide elements in the form of guide pins, which move along the guide rail. If a guide element with a guide roller is used, the profile of the guide rail will advisably have the form of "C" or a "J" in the cross-sectional plane perpendicular to the longitudinal axis and thus be suitable for accepting the guide roller. A profile of this type has one sidepiece which is more-or-less perpendicular to the pivot axis of the lever and to the plane of the door leaf, at least one sidepiece which is more-or-less parallel to the plane of the door leaf, and a rounded sidepiece, which serves as a contact surface for the guide roller. So that defined contact can be established between the locking element and the guide rail, the contact surface is advisably formed by the sidepiece which is more-or-less parallel to the plane of the door leaf. AS already explained above, the invention is used to particular advantage in sectional doors, in which the door leaf is made up of a plurality of panels, which are arranged next to each other in the direction in which the door leaf travels and which are hinged to each other around pivot axes which are perpendicular to the direction in which the door leaf travels.

Within the scope of the invention, it is the intention not only to produce complete doors including the safety device but also to retrofit already existing doors with the device. An inventive safety device suitable for this purpose comprises a locking element, which, when moving into the locking position, arrives between the guide element and the guide rail. This locking element can be mounted on a pivotably supported lever, which for its own part has an opening, through which the support shaft of the guide element passes. The locking element can in this case be mounted on the lever so that it can tilt around a tilt axis which is parallel to the pivot axis. In addition, the locking element can be provided with a support element, which can also have an opening, through which the support shaft of the guide element can pass, where this support element can include a sidepiece which grips the guide rail from behind, this sidepiece being located on the side of the guide rail opposite the contact surface.

The invention is explained in greater detail below on the basis of the drawing, to which reference is explicitly made for all of the details which are essential to the invention but which are not mentioned specifically in the description:

Figure 1:
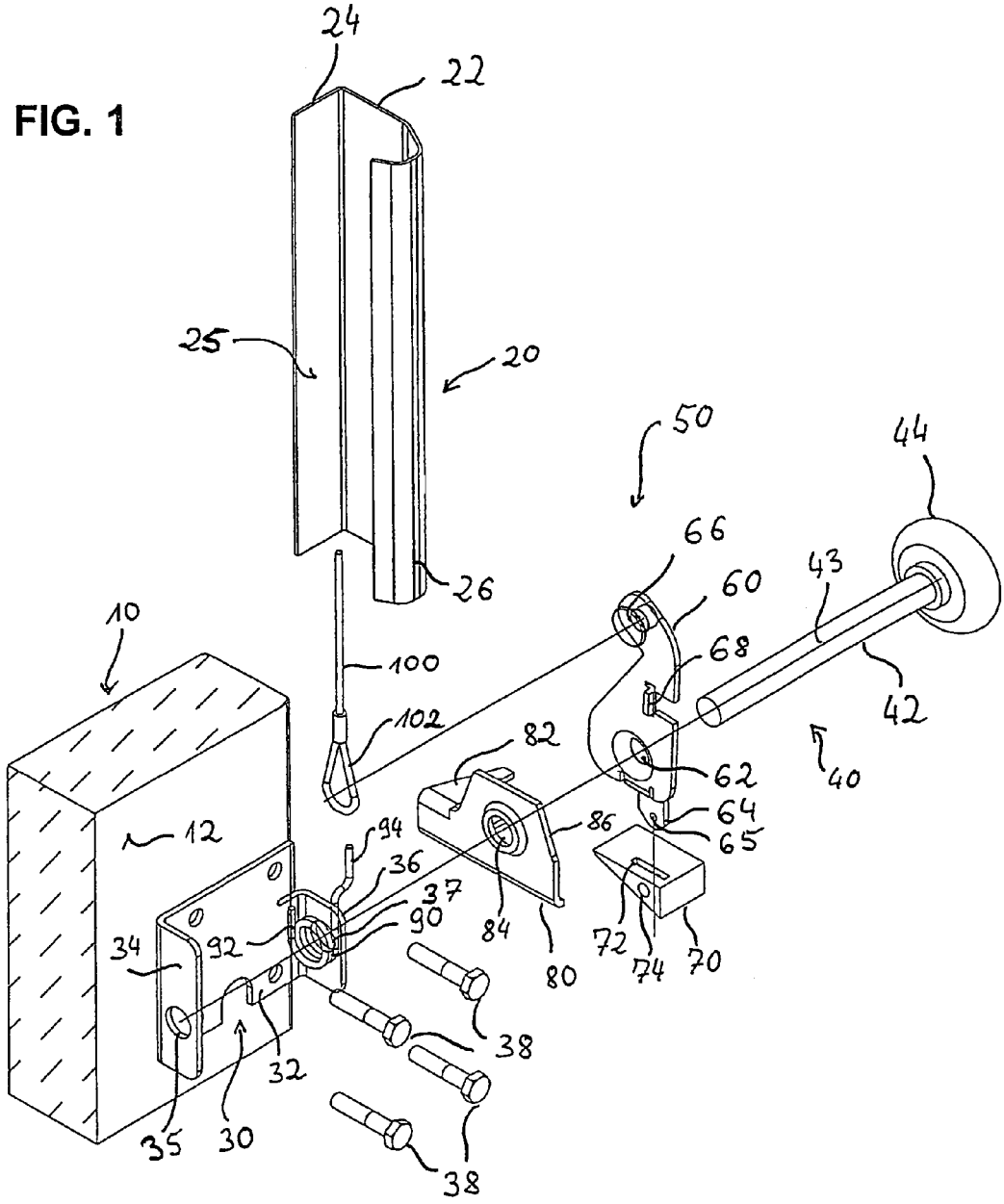
FIG. 1 shows an exploded view of an inventive door equipped with an inventive locking device.

The sectional door shown in the drawing comprises:

a door leaf with a plurality of panels, which are arranged next to each other in the direction of leaf travel and which are hinged together, only the panel which is at the bottom when the door is closed, i.e., panel 10, being shown in the drawing;

a guide rail arrangement with two guide rails located at the two opposite lateral edges of the door leaf, only the section of the guide rail 20 which is more-or-less parallel to a lateral edge of the door leaf when the door is closed being shown in the drawing;

a bracket element 30;

a guide element 40; and a locking device, designated overall by the number 50, where the guide element 40 and the locking device 50 can be attached by means of the bracket element 30 to the inner boundary surface 12 of the pane 10.

The bracket element 30 has the form of a U-shaped profile in the direction perpendicular to the longitudinal direction of the guide rail 20, this profile consisting of a connecting sidepiece 32, which rests against the interior surface 12 of the panel 10, and two outer sidepieces 34 and 36, which are more-or-less perpendicular to the connecting sidepiece.

So that the bracket element 30 can be fixed in place, the connecting sidepiece 32 has a total of four holes, through which fastening screws 38 are passed and introduced into the panel 10. The outer sidepieces 34 and 36 of the bracket element 30 have holes 35 and 37, respectively, which are designed to accept the support shaft 42 of the guide element 40. The holes 35 and 37 are arranged so that the guide element 40 can rotate around an axis of rotation 43, which is perpendicular to the guide rail 20 and parallel to the interior surface 12 of the panel 10. At the end facing the guide rail 20, the support shaft 42 is equipped with a guide roller 44, which, in the assembled state, is held inside the guide rail 20. In the cross-sectional plane perpendicular to its longitudinal direction, the guide rail 20 has a profile in the shape of a "J" with a sidepiece 22 more-or-less perpendicular to the axis of rotation 43 of the guide element 40, a sidepiece 24 forming a clean right angle, and a rounded sidepiece 26, where the rounded sidepiece 26 forms a contact surface for the guide roller 44 and simultaneously prevents the roller 44 from being removed from the guide rail 20 in a direction parallel to the axis of rotation 43.

The locking device, designated overall by the reference number 50, comprises a lever 60; a wedge-shaped locking element 70, which can be mounted on the lever in such a way that that it can tilt; a support element 80; and a pretensioning device, designed as a torsion spring 90. The lever 60 and the support element 80 have through-holes 62, 84, respectively, which are designed to accept the support shaft 42 of the guide element 40. In this way, the lever 60 and the support element 80 can be held on the support shaft 42 and thus also on the panel 10 in such a way that they can pivot around the axis of rotation 43 of the guide element 40. On one side of the through-hole 62, the lever 60 has a projection 64 at its lower edge, through which a hole 65 passes; this projection can be introduced into a slot 72 in the wedge-shaped locking element 70. A hole 74 also passes through a lateral boundary surface of the locking element 70; when the projection 64 is introduced into the slot 72, this through-hole can be brought into alignment with the hole 65, so that the locking element 70 can be attached to the lower edge of the lever 60 so that it can tilt around a tilt axis which is parallel to the axis of rotation 43 of the guide element 40, the attachment being accomplished by inserting a fastening pin (not shown) through the holes 74 and 65. A bolt 66 with a radially expanded head is attached to the lever 60 near the upper edge. In the assembled state, a loop 102 of a tensioning means passes around this bolt. The other end of the tensioning means is attached to a counterbalancing device (not shown) and/or to a drive device (not shown). In the assembled state, the bolt 66 is located in the line of action of force leading to the axis of rotation 43.

The support element 80 comprises a sidepiece 86, which is perpendicular to the support shaft 42 and through which the shaft passes, and a sidepiece 82, which, in the exemplary embodiment shown here, proceeds at a clean right angle from this sidepiece 86. In the assembled state, this sidepiece 82 grips the sidepiece 24 of the guide rail 20 from behind.

Figure 2:
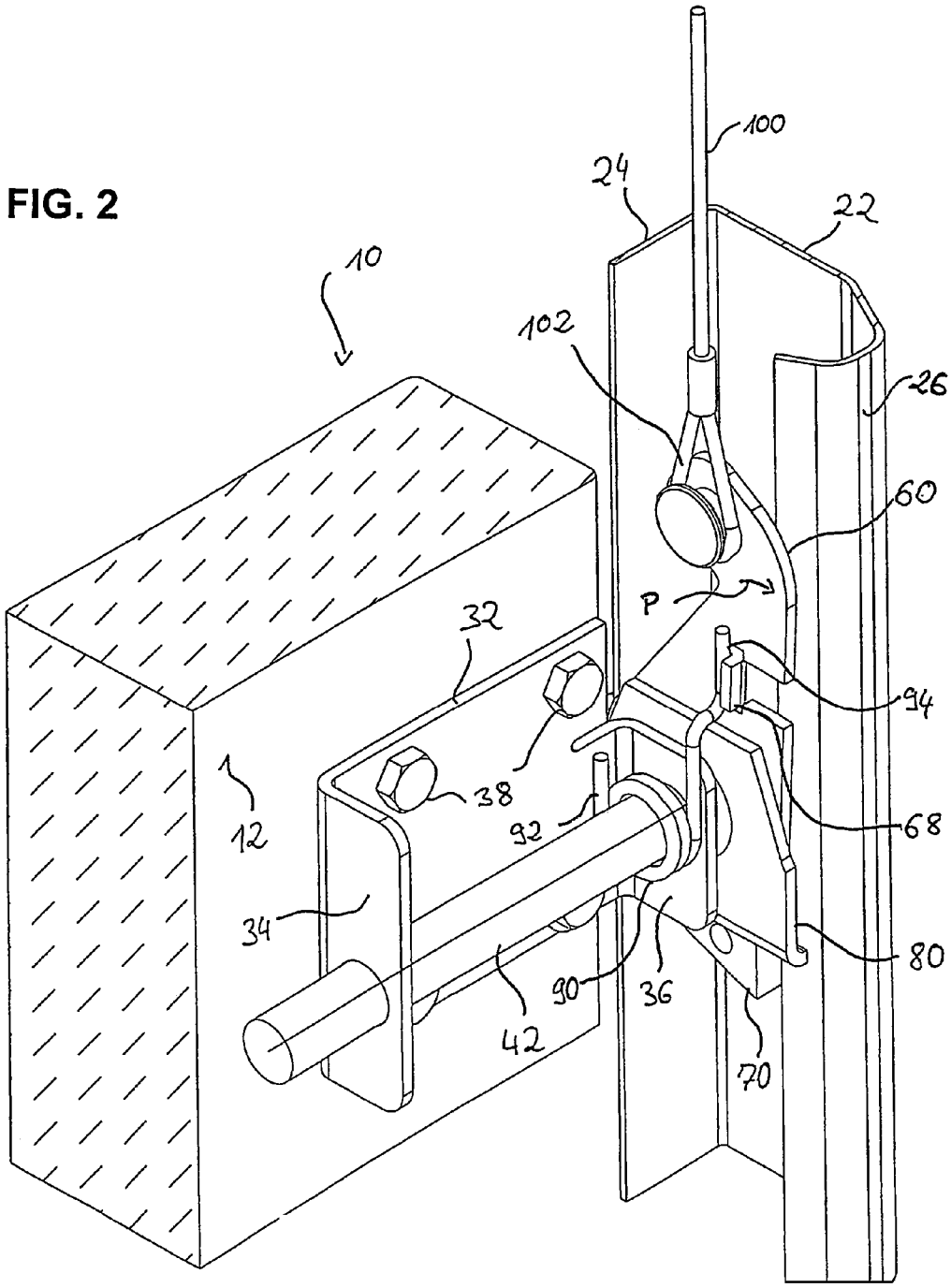
FIG. 2 shows a view of the door shown in FIG. 1 with the locking device in the release position.

One end 94 of the torsion spring 90 grips an abutment 68 of the lever 60, which is bent out at a right angle, while the other end 92 is supported by way of the bracket element 30 against the panel 10. In the assembled state, the lever 60 and the support element 70 are located between the sidepiece 36 of the bracket element 30 and the guide roller 44 of the guide element 40. The lever 66 is pushed by the torsion spring 90 in the direction indicated by the arrow P in FIG. 2. This means that the locking element 70, which is attached to the lower edge of the lever 60 with the freedom to tilt, is pushed by means of the torsion spring 90 toward the cleanly bent right-angled sidepiece 24 of the guide rail 20. At the same time, the lever 60 is being forced by the tensioning means 100 looped around the bolt 66 in the direction opposite the one indicated by the arrow P. As long as the tensioning means 100 and the counterbalancing device or the drive device are undamaged, the goal is therefore achieved that the locking element 70 attached to the lower edge of the lever 60 will be located in the position shown in FIG. 2 between the cleanly bent right-angled sidepiece 24 and the rounded sidepiece 26 of the guide rail 20, in which position it cannot interfere with the movement of the guide roller 44 and therefore cannot interfere with the movement of the door.

If the tensioning means 100 becomes broken and/or the counterbalancing device or the drive device is damaged, the force exerted on the lever 60 via the tensioning means 100 disappears. As a result, the lever 60 will be pushed by the torsion spring 90 in the direction indicated by the arrow P in FIG. 2 and will arrive in the position shown in FIG. 3. In this position, the locking element 70 attached to the lower edge of the lever 60 is between the sidepiece 24 of the guide rail 20 and the roller 44. The contact surface 76 of the locking element 70 facing away from the support shaft 42 is pushed by the guide roller 44, acting on another contact surface 78 of the locking element 70, against a contact surface of the guide rail 20 formed by the inner boundary surface 25 of the sidepiece 24. In this way, the guide roller 44 and thus the door leaf carrying this guide roller 44 are prevented from moving downward, and the door leaf thus cannot drop in an uncontrolled manner.

Figure 3:
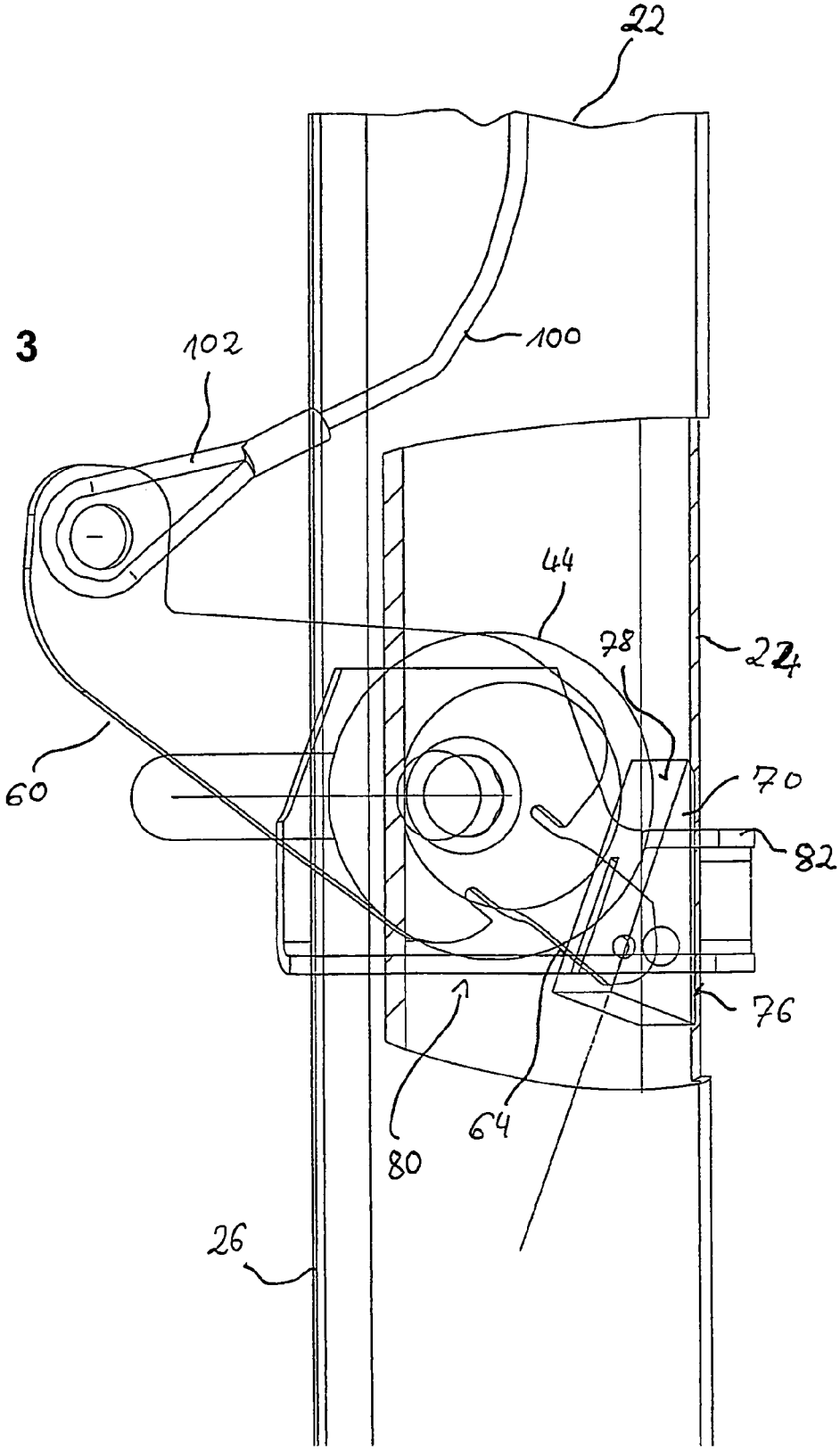
FIG. 3 shows a view of the door shown in FIG. 1 with the locking device in the blocking position.

In the embodiment of the invention shown in the drawing, this blocking effect of the locking element is enhanced by designing the contact surfaces 76 and 78 so that they form an acute angle of approximately 20° with each other. To support the blocking action of the locking element 70, the contact surface 76 acting on the contact surface 25 is made of a hard, roughened material. In the locking device according to the invention, the fact that the locking element 70 arrives in a state of two-dimensional contact with the contact surface 25 eliminates most of the danger that the sidepiece 24 of the guide rail 20 forming the contact surface 25 could, after the locking element 70 has arrived in the blocking position shown in FIG. 3, be deformed under the weight of the door leaf acting on it by way of the guide roller 44 and the locking element 70. The small, still remaining risk of damage to the guide rail 20 by the locking element 70 when in the blocking position shown in FIG. 3 is further reduced by the sidepiece 82 of the support element 80, which grips the guide rail 20 from behind. This is because this sidepiece is always at the same level as the locking element 70 regardless of the position of the door leaf at the time the locking element 76 moves into the blocking position and thus forms an abutment which opposes the outward escape of the guide rail on the side opposite the guide rail's contact surface 25. This positional relationship between the sidepiece 82 of the support element 80 and the locking element 70 always remains in effect regardless of the position of the door leaf because both the lever 60, which carries the locking element 70, and the support element 80 are supported on the same support shaft 43 of the guide element 40.

Because, in the embodiment of the invention shown in the drawing, the locking element acts on the cleanly bent sidepiece 24 of the guide rail 20 and not on the rounded sidepiece 26, which forms the contact surface for the guide roller during normal operation, the functionality of the door is not impaired after the locking element has returned from the blocking position to the release position.

The invention is not limited to the exemplary embodiment explained on the basis of the drawing. On the contrary, it is also intended that the inventive locking devices can be used in conjunction with conventional tilting doors. The guide element can also be designed in the form of a simple guide pin instead of a guide roller. The locking element, furthermore, can also act on a different part of the guide rail.

The invention claimed is:

1. Door, comprising a leaf, which can be moved between an open position and a closed position;

a guide element (40), which is fastened to the leaf and which cooperates with a guide rail (20) to guide the movement of the leaf; and a locking device (50), which can be shifted between a release position, in which it allows the movement of the leaf, and a blocking position, in which it opposes the movement of the leaf, the locking device being equipped with a locking element (70), which, when the device is moved into the locking position, comes to rest against a contact surface (25) of the guide rail (20), in which, when in the locking position, the locking element (70) can be pressed toward the contact surface (25) by a thrust element, which is attached to the door leaf, with a pretensioning device (901, which pushes the locking element (70) into the locking position, such-that the locking element, when in the locking position, is located between the thrust element and the guide rail, wherein the locking device (50) is connected by a tensioning means (100) to a drive device and/or to a counterbalancing device realized in the form of a tension or torsion spring arrangement in such a way that the drive device and/or the counterbalancing device can exert a force on it which opposes the pretensioning force of the pretensioning device (90) and pushes the locking device into the release position; and the locking device (50) has a lever (60), supported so that it can pivot around an axis which is essentially transverse, to the longitudinal direction of the guide rail (20), which lever can be connected on one side of the pivot axis (43) to the tensioning means (100) and on the other side of the pivot axis (43) to the locking element (70), wherein the locking element (70) is mounted on the lever (60) so that it can tilt around a tilt axis which is essentially parallel to the pivot axis (43), wherein, when the locking device (50) is shifted into the locking position, the locking element (70) can be laid against the guide element (40), wherein the locking element (40) has a first, essentially flat contact surface (76), which comes to rest against the contact surface (25) when the device is in the locking position, and a second contact surface (78), which, in the locking position, rests against the guide element (40), where the first contact surface (76) forms an acute angle of less than 30°, with the second contact surface (78).

2. Door according to claim 1, wherein the pretensioning device (90) has a torsion spring, which is supported at one end on the lever (60) and at the other end at least indirectly on the door leaf.

3. Door according to claim 1, wherein the locking device has a support element (82), which is located on the side of the guide rail opposite the guide rail's contact surface.

4. Door according to claim 3, wherein the support element (82) is supported so that it can pivot around the pivot axis (43).

5. Door according to claim 1, wherein the guide element (40) has a support shaft (42), which is essentially perpendicular to the longitudinal axis of the guide rail (20) and parallel to the plane of the door leaf, which shaft passes through the lever (60), through the torsion spring (90), and/or through the support element (80).

6. Door according to claim 1, wherein the locking device (50) can be attached to the door leaf by a bracket element (30).

7. Door according to claim 6, wherein the bracket element (30) has a U-shaped profile with a connecting sidepiece (32), which is attached to a boundary surface of the door leaf, and two outer sidepieces (34, 36), through which the support shaft (42) passes.

8. Door according to claim 1, wherein the locking device (50) is located in the area of the edge of the door leaf which is at the bottom when the door is closed.

9. Door according to claim 1, wherein the guide element (40) has a guide roller (44), which is supported so that it can rotate around the longitudinal axis of the support shaft (42).

10. Door according to claim 9, wherein, in the cross-sectional plane perpendicular to its longitudinal axis, the guide rail (20) has a profile in the shape of a "C" or a "J" and is designed to accept the guide roller (44).

11. Door according to claim 1, wherein the contact surface (25) is essentially parallel to the plane of the door leaf.

12. Door according to claim 1, wherein the door leaf has a plurality of panels (10), which are arranged next to each other in the direction of door leaf travel and are hinged to each other so that they can pivot around pivot axes which are perpendicular to the direction of door leaf travel.

13. Locking device for a door according to claim 1 with a locking element (70), which, when in the locking position, is located between a thrust element, which is attached to the door leaf, and the guide rail (20).

14. The door according to claim 1, wherein the locking element (70) can be pressed toward the contact surface (25) by a thrust element and the guide element (40).

15. The door according to claim 1, wherein the angle between the first contact surface (76) and the second contact surface (78) is approximately 20°.

16. Locking device for a door according to claim 13 with a locking element (70), which, when in the locking position, is located between the guide element (40), which is attached to the door leaf, and the guide rail (20).

* * * * *